United States Patent [19]

Redl et al.

[11] Patent Number: 4,619,281

[45] Date of Patent: Oct. 28, 1986

[54] UMBRELLA WITH IMPROVED WIND-UP HANDLE

[76] Inventors: Richard S. Redl; Robert F. Redl, both of 15 E. Summit Ave., Midland Park, N.J. 07432

[21] Appl. No.: 741,544

[22] Filed: Jun. 5, 1985

[51] Int. Cl.[4] ..... A45B 17/00

[52] U.S. Cl. ..... 135/20 M; 242/100; 242/106

[58] Field of Search ..... 135/20 M; 242/100, 106

[56] References Cited

U.S. PATENT DOCUMENTS 2,053,458 9/1936 Black ..... 242/100

FOREIGN PATENT DOCUMENTS 683187 2/1965 Italy ..... 135/20 M

*Primary Examiner*—Albert W. Davis, Jr.

*Attorney, Agent, or Firm*—Richard J. Rodrick

[57] ABSTRACT

An umbrella comprises a cover having open and closed positions. A hollow pole supports the cover. An operative wind-up assembly for selectively opening and closing the cover includes a mechanism mounted on the pole. A cable extends from the wind-up mechanism through the inside of the pole for activating the cover. Part of the wind-up mechanism includes a rotatable handle with an interiorly positioned spool. One end of the cable is attached around the spool for winding the cable when the handle is rotated to cause opening of the cover.

16 Claims, 4 Drawing Figures

UMBRELLA WITH IMPROVED WIND-UP HANDLE

BACKGROUND OF THE INVENTION

1. Field of the Invention.

The present invention relates to an umbrella, and more particularly, concerns a foldable umbrella with an improved wind-up handle for opening and closing the umbrella 2. Description of the Prior Art.

Foldable or collapsible umbrellas intended to provide a shady environment for users normally are available in large sizes. Typical of such shade-providing umbrellas are those which are used on the beach, lawn, patio, terrace and the like. Inasmuch as these larger umbrellas for shade purposes tend to be heavier and bulkier than hand-held umbrellas, it is known, and has been customary, to include a wind-up mechanism for raising and lowering the umbrella cover. Rotatable handles or cranks are commonly known for use on shade-type umbrellas, an example of which is found in U.S. Pat. No. 2,747,591. Wind-up mechanisms are also available on beach umbrellas which tilt, one such wind-up mechanism being described in U.S. Pat. No. 4,386,621.

Most beach or lawn umbrellas presently available for retail purchase include a number of components which are made to industry-wide standards by most manufacturers. For example, the long, hollow pole for supporting the umbrella is generally made to a singular specification particularly since many of these lawn umbrellas are intended to be inserted through standard holes in outdoor patio furniture. Most of the poles for such outdoor umbrellas have a nominal inside diameter of 1.25 inches (31.8 mm) and an outside diameter of 1.375 inches (35.0 mm). Another part which is common to most manufacturers of outdoor umbrellas is a shaft, such as a bolt or pin, which extends through the hollow pole for purposes of mounting the wind-up mechanism to the pole. A standard shaft for this purpose has a diameter of ¼ inch (6.35 mm). In some instances, the diameter of the mounting shaft might be 5/16 inch (7.94 mm). Most manufacturers also use a standard cord which extends from the wind-up mechanism to a lift device for raising and lowering the umbrella cover. A nylon or other fabric-based cord having a diameter of ⅛ inch (3.2 mm) is relatively common to the umbrella industry.

Keeping in mind the aforementioned standard components and sizes, it normally takes about 28 complete revolutions of a wind-up handle to open a lawn umbrella from the closed position to the completely open position. Of course, the same number of turns is required to lower the umbrella from the open to the closed position. This many turns of the rotatable wind-up mechanism is not only tiring for the user, but also means that the raising or lowering of the umbrella takes a relatively long time. If improvements in the wind-up mechanism are to be directed to saving time and effort by reducing the number of turns for completing the raising or lowering operation, some ideas come ready to mind to one skilled in this art. For instance, a larger diameter wind-up shaft could be employed. In typical, presently available lawn umbrellas, this wind-up shaft extends transversely across the hollow interior of the umbrella pole, and is connected to the wind-up handle. When the handle is turned, the wind-up shaft is turned and the cord inside the pole is wound around the shaft.

Increasing the diameter of the wind-up shaft from the standard ¼ inch (6.35 mm) would reduce the number of turns required to raise or lower the umbrella. However, such increase in the diameter of the wind-up shaft necessitates a deviation from the size of shaft normally used by this industry. Moreover, if the wind-up shaft were to substantially increase in diameter, it would be more difficult to wind the cord around the shaft inside the pole, inasmuch as there is only a limited amount of space within the pole for winding purposes.

Other changes which could be employed to reduce the number of turns for raising or lowering the umbrella include an increase in the size of the cord or an increase in the inside diameter of the pole to accommodate a larger wind-up shaft. Once again, such changes along these lines would involve a deviation from standard components known and used by the outdoor umbrella industry.

Furthermore, some manufacturers of outdoor umbrellas provide umbrella poles which have various ornamental designs around the outside diameter. In order to accommodate these ornamental or fancy designs, it is often necessary to reduce the inside diameter of the pole so as to provide greater wall thickness with which to create such ornamental designs. If the inside diameter of the umbrella pole is reduced, it would be very difficult to increase the diameter of the wind-up shaft in order to reduce the number of turns for raising or lowering the umbrella.

Different handle or crank mechanisms may be employed for raising or lowering the umbrella cover. For instance the garden umbrella described in U.S. Pat. No. 3,744,503 employs a sliding lever mechanism associated with a cable extending inside the umbrella pole in order to open the umbrella from a closed position. The inventors of U.S. Pat. No. 3,744,503 suggest that the sliding lever mechanism for opening the umbrella is an improvement over standard rotatable crank umbrellas which take a long time to open or close in view of the large number of revolutions of the crank. On the other hand, the umbrella raising mechanism of this patent leaves all of the work to the individual who is operating the umbrella. Specifically, movement of the lever to open the umbrella requires force by the individual user of sufficient magnitude to pull the entire weight of the umbrella cover from the closed position to the open position. Thus, the sliding lever mechanism does not provide the same type of mechanical advantage attributed to a rotatable crank mechanism, irrespective of the number of revolutions required to raise the umbrella. Such mechanical advantage of a rotating crank mechanism is typified by a fishing reel device such as that described in U.S. Pat. No. 2,691,492.

It can be seen that improvements are still being sought in rotatable handle wind-up mechanisms for raising and lowering umbrellas suitable for outdoor use. In particular, improvements are needed in the time required to raise or lower the umbrella, while at the same time reducing the number of revolutions of the wind-up handle for completing the raising or lowering operations. It is to such improvements, and other improvements as well, that the present invention is directed.

SUMMARY OF THE INVENTION

The umbrella of the present invention comprises a cover having open and closed positions. A hollow support is provided for the cover. Operative means for selectively opening and closing the cover includes wind-up means mounted on the support. Part of the operative means is a cable extending from the wind-up means through the inside of the support for activating the cover. The wind-up means includes a rotatable handle having an interiorly positioned spool to which one end of the cable is attached. The cable winds around the spool when the handle is rotated to cause the opening of the cover.

In a preferred embodiment of the invention, a foldable umbrella comprises a collapsible cover. Means for operatively moving the cover between open and closed positions are provided. A hollow pole supports the cover and extends generally downwardly with respect to the cover when open. A cord extends within the hollow pole, one end of the cord being connected to the aforementioned operative means. Connected to the pole is a housing to which a handle is rotatably mounted. The mounting of the handle and the housing to the pole is achieved by a shaft which extends substantially transversely through the pole. Preferably, this shaft is mounted so as to be non-rotatable when the handle is rotated. The handle includes a wind-up spool completely enclosed within the interior of the handle, with the spool being positioned substantially concentrically with respect to the shaft. Preferably, the diameter of the spool is larger than the diameter of the shaft. Both handle and spool are integrally formed as a unitary structure from the same material. A side opening in the pole is located adjacent to and is covered by the housing. The cord extends through the opening, with one end of the cord being connected to the spool. Rotation of the handle causes the cord to wind around the spool inside the handle for opening the cover.

In accordance with the principles of the present invention, a rotatable-type wind-up mechanism is provided for outdoor umbrellas with many advantages over existing wind-up mechanisms. Most notably, the wind-up handle of the present invention allows the umbrella cover to be raised or lowered by significantly fewer revolutions of the rotatable handle than presently known and available rotatable handles. Consistent with the reduction in number of turns is a reduction in time required to raise or lower the umbrella cover. Further, the new handle of the present invention may be used with standard components which are well accepted on an industry-wide basis for outdoor umbrellas, i.e. standard pole sizes, cords and mounting shafts may be utilized with the present invention. Indeed, inasmuch as the handle mechanism of the present invention permits the cord to be wound on the outside of the pole, the new handle described herein will be very compatible with poles of different diameters. Thus, those ornamental or designed poles which utilize a smaller inside diameter than the industry standard will find that the present wind-up handle not only offers the advantages as herein described, but also can be made attractively to match the ornamental features. It should also be noted that the new handle of the present invention takes advantage of the fact that the wind-up cord is maintained within the interior of the hollow pole. With this type of arrangement, the cord is typically hidden from sight, and also protected from the weather so that it does not break too readily. Another feature of the present invention relates to the mounting shaft for holding the rotatable handle in position on the pole. Whereas mounting shafts of presently known rotatable handles rotate when the handle is rotated, the shaft of the present invention is preferably non-rotatable. As a result, the lock and torque nut which is used to hold the shaft in place are prevented from loosening during rotation of the handle. Ease of assembly of the present invention is achieved due to the straightforward design of the components of the handle and because such components are few in number. Other advantages of the present invention will be perceived by a reading of the detailed description which follows.

DETAILED DESCRIPTION

Figure 1:
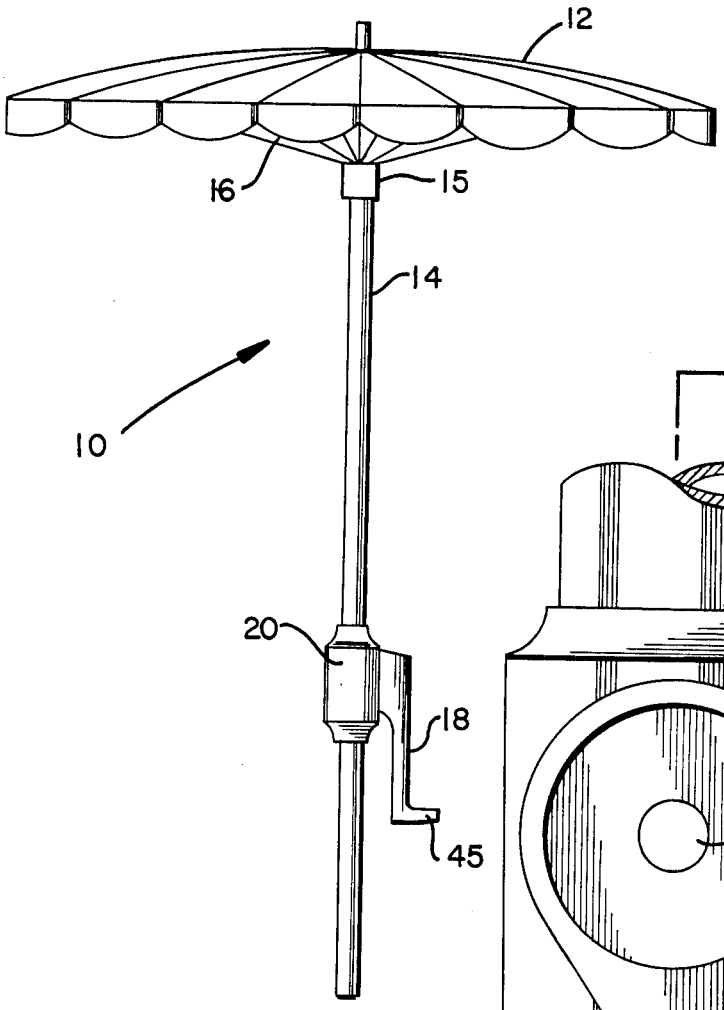
FIG. 1 is a side elevational view of the umbrella of the present invention embodying the preferred wind-up mechanism.

While this invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be measured by the appended claims and their equivalents.

Referring now to the drawings, and FIG. 1 in particular, there is illustrated an umbrella 10 as it may appear in the open position. Umbrella 10 is ideally suitable for outdoor use, for providing shade for example, on the beach, lawn, patio, garden and other outdoor uses. Of course, the wind-up mechanism to be described hereinafter is not restricted to umbrellas for shade purposes, but could be used on any type of umbrella-type product in which a wind-up mechanism is utilized for opening and closing purposes.

Umbrella 10 includes a collapsible cover 12 supported by a pole 14. Typically, the pole extends generally downwardly with respect to the cover when the cover is open, as illustrated in FIG. 1. Although pole 14 is illustrated as being straight and in one section, it is within the purview of the present invention for umbrella 10 to be the tilting type, such as described in U.S. Pat. No. 4,386,621. In that case, the umbrella pole may be provided in two sections connected by a pivot mechanism to allow the umbrella cover to be tilted when desired.

Collapsible cover 12 is operatively associated with pole 14 by means of a slidable collar 15 and framework 16. The framework employed with the umbrella of the present invention is well-known and normally includes a plurality of radially extending spokes between collar 15 and the underside of cover 12. When the wind-up handle 18 is rotated, as will hereinafter be described, collar 15 slides down along pole 14 to thereby collapse cover 12 to a closed position against the pole. Cover 12 is raised or opened by turning the wind-up mechanism in the reverse direction. It can be seen in FIGS. 1 and 2 that wind-up handle 18 is mounted on the side of pole 14. So as to provide for smooth rotation of the handle, and a mechanism for holding the handle onto the pole, a housing 20 is provided.

Figure 2:
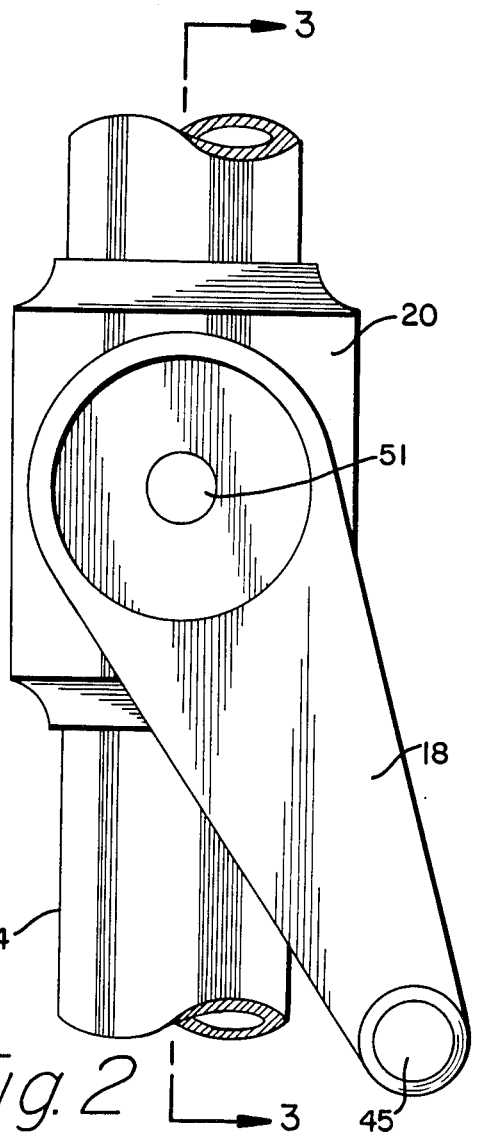
FIG. 2 is an enlarged side elevational view of the preferred wind-up mechanism of the present invention.
Figure 3:
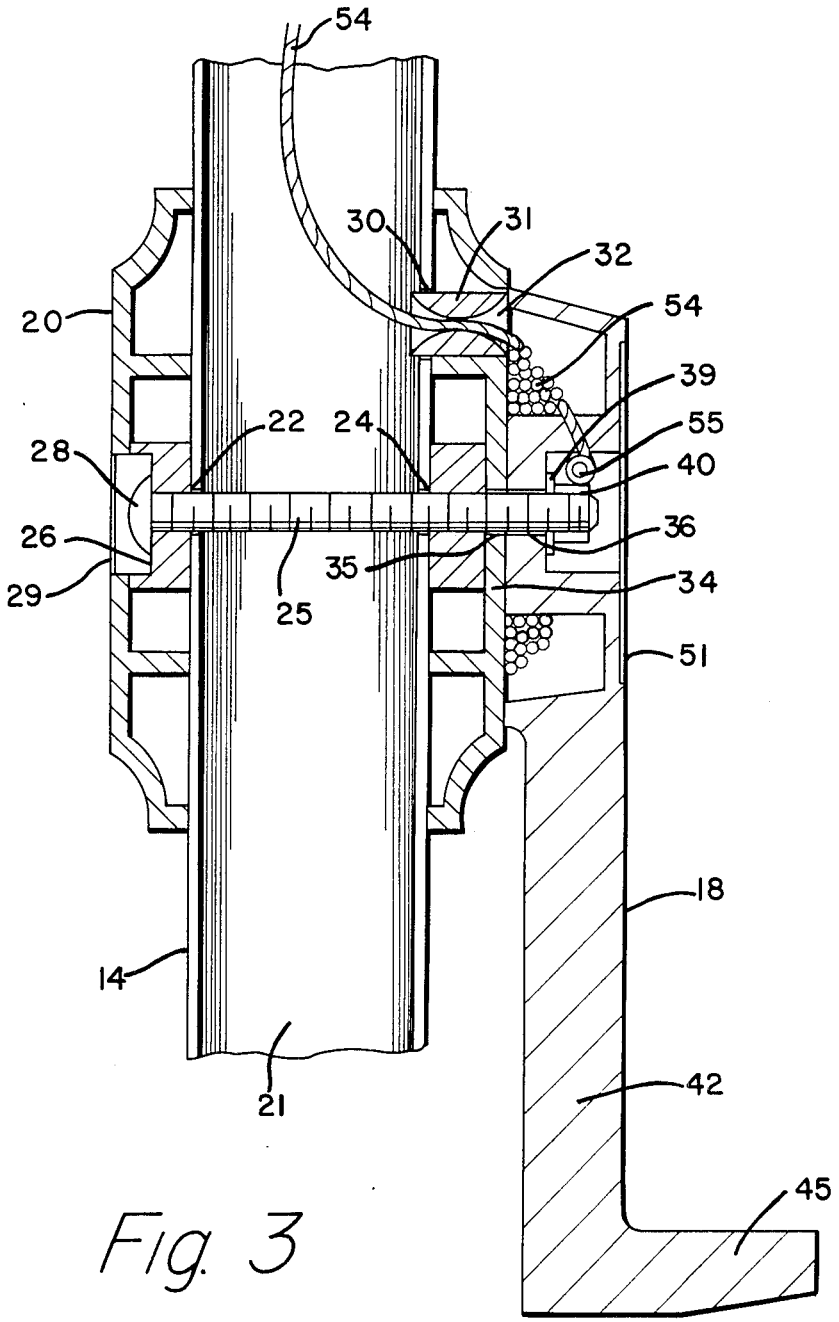
FIG. 3 is an enlarged cross-sectional view of the wind-up mechanism taken along line 3—3 of FIG. 2.
Figure 4:
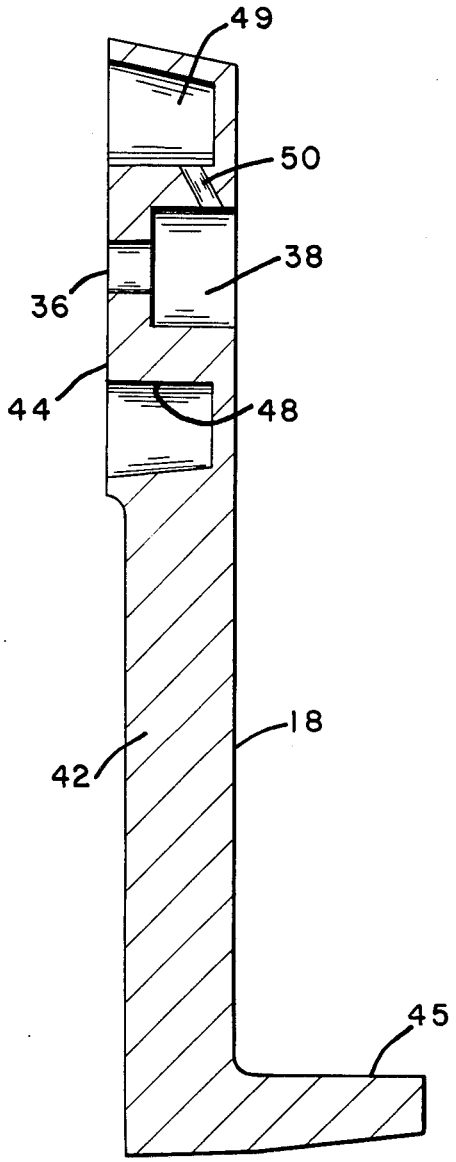
FIG. 4. is an enlarged cross-sectional view illustrating only the handle of FIG. 3.

Turning now to FIGS. 2,3 and 4, the details of the preferred wind-up mechanism of the present invention are more clearly illustrated. It can be seen that pole 14 is preferably a tubular member with a hollow interior 21. Housing 20 is desirably an encasement which surrounds the outside diameter of pole 14. Two aligned holes 22 and 24 are provided through pole 14. A mounting shaft 25 extends transversely across the pole and through holes 22 and 24 for mounting housing 20 against pole 14. A countersink 26 is recessed into the side of housing 20 so that the head 28 of mounting shaft 25 may be accommodated. So that head 28 of the mounting shaft may not be seen, a cover or plate 29 may be included over countersink-recess 26, thereby providing an attractive appearance for the housing. It should be pointed out that mounting shaft is preferably a bolt of standard size, typically being about ¼ inch (6.35 mm) in diameter or 5/16 inch (7.94 mm) in diameter. Of course, the size of mounting shaft 25 may vary according to the particular design needs of the present invention.

Pole 14 also includes another hole or opening 30 through one side thereof. Hole 30 is preferably positioned so that it is adjacent housing 20 and is covered by the housing. Positioned in hole 30 is a wear-bushing 31 which extends into and is encompassed by housing 20. This bushing may be fixed in position within the housing and hole 30 by a press fit, adhesives, or the like. Extending through bushing 31 is a passageway 32 which communicates with hollow interior 21 of the pole. It can be seen in FIG. 3 that passageway 32, and the main axis of bushing 31, lie substantially transversely to the longitudinal axis of pole 14.

Housing 20 is preferably configured so that outside surface 34 is a substantially flat face. This flat-faced surface facilitates the smooth, clean rotation of handle 18 with respect to the housing. It can be seen in FIG. 3 that bushing 31 is positioned so that its passageway 32 is open to face 34. Hole 35 is provided through face 34 so that mounting shaft 25 is able to protrude beyond flat-face 34. This protrusion facilitates the mounting of handle 18 to housing 20. Handle 18 includes a hole 36 intended for alignment with hole 35 extending through surface 34 of the housing. Hole 36 of the handle opens up to a recessed cavity 38 which is countersunk into the body of the handle. A lock washer 39 and lock nut 40 are provided to complete the mounting of handle 18 and housing 20 to pole 14. It is preferred that this mounting be arranged so that mounting shaft 24 is non-rotatable within the pole when the handle is being rotated. By preventing rotation of mounting shaft 25, loosening of lock washer 39 and lock nut 40 will be prevented. The shapes of the various holes through pole 14, housing 20 and handle 18 may all be designed to mate with the mounting shaft so as to prevent its rotation when the handle is being turned.

With particular reference to FIG. 4, taken in conjunction with FIG. 3, it can be seen that handle 18 includes an arm portion 42 extending downwardly from a hub area 44 through which hole 36 extends. At the distal end of arm 42 is a flange 45, which may be a knob or the like, for grasping by the user to rotate the handle. Hub portion 44 includes an interiorly formed drum or spool 48. Surrounding spool 48 is a winding area defined by a cavity 49 which opens to the inside face of hub portion 44. It is preferred that spool 48 be completely enclosed within the interior of hub portion 44 of the handle. A slot 50 through spool 48 provides communication between recess 38 and cavity 49.

When handle 18 is mounted against housing 20, the interior of hub portion 44 is mounted directly against flat face 34 of the housing. It can be seen that cavity 49 covers bushing 31 so that the passageway through the bushing and cavity 49 of the handle are in communication with each other. It should also be noted that the diameter of spool 48 is significantly larger than the diameter of mounting shaft 25. The importance of this diameter differential will become more apparent hereinafter. It is also preferred that spool 48 be positioned substantially concentrically with respect to mounting shaft 25 so that the winding operation may be performed more smoothly. To provide a clean, finished, attractive appearance, a cover 51 may be provided over recess 38 thereby hiding the nut and mounting shaft from view.

A flexible cable 54, such as a cord or the like, is utilized to cause the raising and lowering of umbrella cover 12 in conjunction with the wind-up mechanism herein described. One end of cord 54 is connected to collar 15 and framework 16 (not shown in the drawings), in a fashion which is well-known and understood by those skilled in the art of lawn and beach umbrellas. Cord 54 extends within hollow interior 21 of the pole, where it is not only out of view to users of the umbrella, but is also protected from the elements by being so enclosed. The other end of cord 54 extends through passageway 32 of the wear-bushing, through cavity 49 and then through slot 50 of the handle into recess 38. A knot 55 is typically provided at that end of the cord so that the cord is anchored to spool 48. Of course, other affixing mechanisms, besides a knot, may be employed to hold the cord in place with respect to the spool. By virtue of the interior formation of the spool 48 and its associated cavity 49, as well as cover plate 51, cord 54 is completely unseen by the user. Moreover, since the cord is completely confined within the pole and the wind-up mechanism as herein described, there is no possibility for the cord being snagged or caught by objects lying exterior to the umbrella.

If the umbrella is in the closed position, cover 12 may be raised to the open position by rotating handle 18 either in a clockwise or counterclockwise direction. Rotation of the handle causes cord 54 to wind around interior spool 48 and fill up cavity 49, as illustrated in FIG. 3. As cord 54 winds around spool 48, it slides quite smoothly through passageway 32 of wear-bushing 31. It can be seen that cord 54 passes through wear-bushing 31 in a direction substantially transverse to the longitudinal axis of the umbrella pole. Winding of the cord around the interior spool of the handle causes the cord to pull collar 15 upwardly along pole 14 thereby opening cover 12. Reverse winding of handle 18 causes cord 54 to unwind thereby lowering cover 12 to the closed position.

By winding cord 54 around interior spool 48, the present invention provides a much quicker opening and closing of the umbrella than existing wind-up mechanisms. In presently available lawn umbrellas, the wind-up cord is typically wound around the transverse mounting shaft (which rotates). With a standard size mounting shaft and inside diameter umbrella pole, it typically takes about 28 turns of the handle to raise or lower the umbrella cover. On the other hand, the diameter of interior spool 48 of the present invention is related to the speed with which the umbrella may be opened or closed. For instance, and for exemplary purposes only, the diameter of spool 48 may be about 1 inch (25.4 mm) in diameter. Since this diameter is significantly larger than the diameter of a standard mounting shaft, winding the cord around the interior spool of the shaft results in opening and closing the umbrella in many fewer turns of the handle. A typical number of handle rotations envisioned by the present invention, for opening or closing the umbrella, would be about twelve. Fewer rotations of the handle is a significant savings in effort to open or close the umbrella.

Moreover, the wind-up mechanism of the present invention is adaptable to poles of different diameters without necessarily changing the speed of opening or closing the umbrella. In addition, the wind up mechanism of the present invention is suitable for those poles which have ornamental or fancy outside designs, while requiring a smaller inside diameter to accommodate such ornamental features.

Handle 18 may be fabricated in an economical fashion by making it all one piece. Thus, handle 18 with its hub section 44, arm 42, flange 45 and spool 48 are preferably integrally formed as a unitary structure from the same material. Choice of materials may vary, but light-weight metals or rigid plastics may be desirably utilized.

With respect to housing 20, light-weight, but rigid plastic may be used, among other materials, not only for sake of economics, but to provide attractive appearance or designs. Wear-bushing 31 is preferably a wear-resistant plastic or metal material which facilitates the sliding of cable 54 through passageway 32 without fraying the cord. Smooth tapered openings into and out of passageway 32 contribute to the freely sliding movement of the cable through the wear-bushing.

Thus, the present invention provides an umbrella with an improved wind-up handle. In accordance with the present invention, the umbrella may be opened or closed much more rapidly than existing umbrellas using rotation-type handles. The components of the present invention lead to easy and straightforward assembly, and may be used on different size umbrella poles without compromising the aforementioned advantages.

What is claimed is:

1. An umbrella comprising:

a collapsible cover;

means for operatively moving said cover between open and closed positions;

a hollow pole supporting said cover;

a flexible cable extending within said hollow pole, one end of said cable being connected to said means for moving;

handle means mounted on the exterior of said pole and including a rotatable handle and a wind-up spool adapted to rotate when the handle rotates; and said pole having a side opening through which said cable extends, the other end of said cable being connected to said spool whereby rotation of said handle causes said cable to wind around said spool for opening said cover.

2. The umbrella of claim 1 wherein said handle means includes a housing connected around said pole, said handle being rotatably mounted to said housing.

3. The umbrella of claim 1 wherein said housing and said handle are connected to said pole by a shaft extending substantially transversely through said pole.

4. The umbrella of claim 3 wherein said shaft is non-rotatably connected with respect to said pole.

5. The umbrella of claim 1 wherein said spool is located within the interior of said handle.

6. The umbrella of claim 5 wherein said spool is completely enclosed within the interior of said handle.

7. The umbrella of claim 3 wherein said spool is completely enclosed within the interior of said handle and is positioned substantially concentrically with respect to said shaft.

8. The umbrella of claim 7 wherein the diameter of said spool is larger than the diameter of said shaft.

9. The umbrella of claim 7 wherein said handle and said spool are integrally formed as a unitary structure from the same material.

10. The umbrella of claim 1 wherein said side opening through said pole is located adjacent said handle means.

11. The umbrella of claim 10 wherein the mounted handle means covers said side opening.

12. The umbrella of claim 11 which further includes a bushing in said opening, said flexible cable extending through said bushing in a direction substantially transverse to the longitudinal axis of said pole.

13. The umbrella of claim 12 wherein said bushing provides communication between the hollow interior of said pole and the interior of said handle so that the cable is slidable through the bushing as it extends between the spool and the interior of the

14. A foldable umbrella comprising:

a collapsible cover;

means for operatively moving said cover between open and closed positions;

a hollow pole supporting said cover and extending generally downwardly with respect to said cover when open;

a cord extending within said hollow pole, one end of said cord being connected to said means for moving;

a housing connected around said pole;

a handle rotatably connected to said housing by a shaft extending substantially transversely through said pole, said handle having a wind-up spool completely enclosed within the interior of said handle, said spool being positioned substantially concentrically with respect to said shaft, said handle and said spool being integrally formed as a unitary structure from the same material; and said pole having a side opening adjacent to and covered by said housing, said cord extending through said opening, the other end of said cord being connected to said spool, whereby rotation of said handle causes said cord to wind around said spool inside the handle for opening the cover.

15. The umbrella of claim 14 which further includes a bushing in said opening, said cord extending through said bushing.

16. The umbrella of claim 14 wherein said shaft is non-rotatably connected with respect to said pole.

* * * * *